United States Patent [19]

Reggia et al.

[11] 3,987,458

[45] Oct. 19, 1976

[54] LOW-PROFILE QUADRATURE-PLATE UHF ANTENNA

[75] Inventors: Frank Reggia, Bethesda, Md.; Howard S. Jones, Jr., Washington, D.C.

[73] Assignee: The United States of America as represented by the Secretary of the Army, Washington, D.C.

[22] Filed: July 25, 1975

[21] Appl. No.: 599,218

[52] U.S. Cl. ..... 343/846; 343/708; 343/895; 343/770

[51] Int. Cl.[2] ..... H01Q 1/28

[58] Field of Search ..... 343/846, 847, 848, 849, 343/770, 771, 705, 708, 797, 895

[56] References Cited

UNITED STATES PATENTS

| | | | |
|---|---|---|---|
| 3,015,101 | 12/1961 | Turner et al. | 343/895 |
| 3,701,157 | 10/1972 | Uhrig | 343/708 |
| 3,811,127 | 5/1974 | Griffee et al. | 343/846 |

*Primary Examiner*—Alfred E. Smith
*Assistant Examiner*—Tommy P. Chin
*Attorney, Agent, or Firm*—Nathan Edelberg; Robert P. Gibson; Saul Elbaum

[57] ABSTRACT

A low-profile UHF antenna comprises two orthogonally positioned parallel plate radiators that are semicircular in shape. The base of each radiator (filled with dielectric material) is connected to a circular metal ground plane. The radiators can be collectively excited with a single input feed or they can be independently excited in any phase relationship for changing direction or polarization of the radiation field. Thus, the antenna is capable of operating in either a linear or circular polarization mode. The antenna can also be switched rapidly from one linear polarization to a second linear polarization in a perpendicular plane by using techniques familiar to the art.

16 Claims, 5 Drawing Figures

LOW-PROFILE QUADRATURE-PLATE UHF ANTENNA

RIGHTS OF THE GOVERNMENT

The invention described herein may be manufactured, used, and licensed by or for the United States Government for governmental purposes without the payment to us of any royalty thereon.

BRIEF DESCRIPTION OF THE PRIOR ART

Traditionally, UHF antennas have been designed in a manner necessitating physically large dimensions. By this, it is meant that many prior art UHF antennas did not constitute a low-profile design which is necessary where space limitations exist and low visibility is required.

In those UHF antennas that are designed in a low-profile manner, there have been customary limitations on the type of polarized mode which the antenna is capable of operating.

BRIEF DESCRIPTION OF THE PRESENT INVENTION

The present invention offers a new design for a low-profile UHF antenna which is capable of operating in either a linear or circularly polarized mode. The antenna essentially includes two orthogonally positioned parallel plate radiators which are filled with dielectric material. The radiators can be collectively excited with a single input feed or they can be independently excited in any phase relationship for changing direction and/or polarization of the radiation field. This is facilitated by providing two separate coupling probes at the input of the radiator. The antenna can also be switched rapidly from one linear polarization to a second linear polarization in a perpendicular plane by using techniques already familiar to the art.

DETAILED DESCRIPTION OF THE INVENTION

Figure 1:
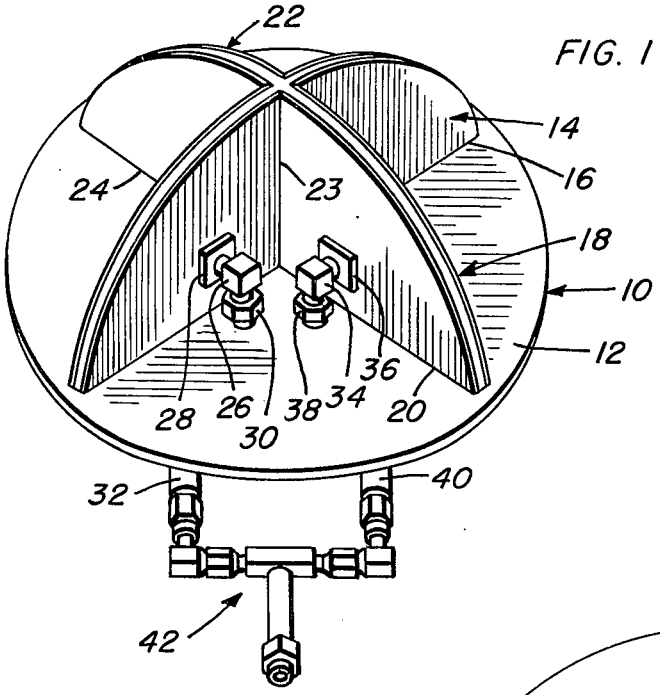
FIG. 1 is a perspective top view of a first embodiment of present antenna.

Referring to FIG. 1, the present antenna design is generally indicated by reference numeral 10. An r.f. ground plane 12 is fabricated from a conductor and is shaped in the form of a circular disc. A first semi-circular radiator plate 14 is mounted perpendicularly to the metal ground plane 12 along a weld line 16, or other appropriate means of fastening. A second semi-circular radiator plate is similarly attached to the ground plane 12. In the illustrated embodiment, this second semi-circular radiating plate is comprised of quadrant portions 18 and 22 and they are positioned in coplanar relationship to each other. The quadrant portions are connected, respectively, at 20 and 24, along radial edges to the ground plane 12. Opposite radial edges are suitably welded at 23, or otherwise appropriately fastened to the semi-circular plate 14. As will be explained hereinafter, each of the semi-circular radiator plates have a dielectric substrate with conductor coatings to serve as radiating elements.

Although a semi-circular plate has been described as comprising two quadrant radiator plates 18 and 22, it is to be appreciated that a semi-single molded x-shaped radiator assembly may be fabricated. The important design criterion is that two orthogonally disposed semi-circular plates exist, which extend perpendicularly from the ground plane 12, the semi-circular plates being orthogonal to one another.

The semi-circular plate 14 has a coupling probe as an input, as indicated by reference numeral 26. The input probe is suitably attached by means of welding, or the like, as shown by 28. The probe input cable extends downwardly at 30, through the ground plane, to connector 32. Similarly, an input probe 34 is suitable attached at 36 to the second semi-circular radiator comprising sections 18 and 22. The probe input cable 34 extends downwardly, at 38, through the ground plane to a separate connector 40. The connectors 32 and 40 may be linked by an r.f. connector 42. This permits simultaneous in-phase driving of both semi-circular radiators. Alternately, the connectors 32 and 40 may be independently driven. As a further alternative, a conventional r.f. input switch 41 may be provided in line with the connectors 32 and 40 for selectively permitting the input signals to be switched between the radiators.

Figure 2:
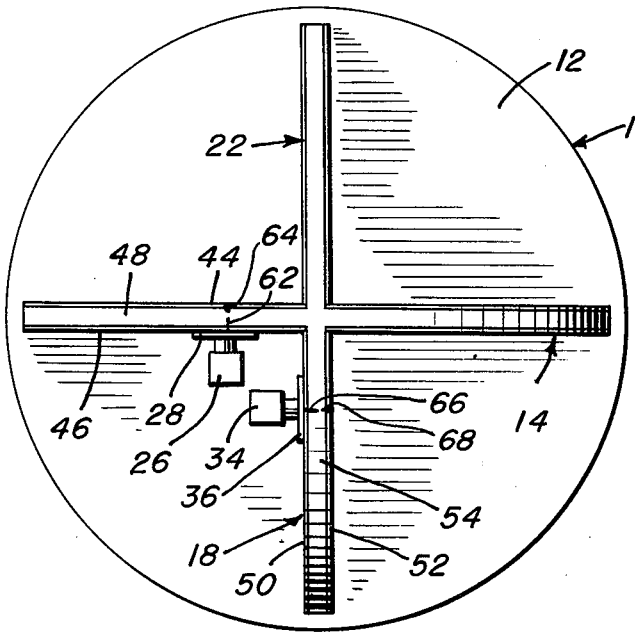
FIG. 2 is a top view of a first embodiment of the present antenna.
Figure 3:
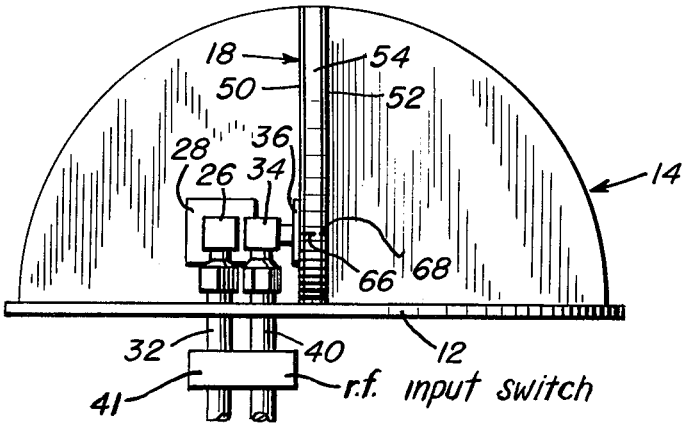
FIG. 3 is a side view of a first embodiment of present antenna.

FIGS. 2 and 3 illustrate the present antenna in different views. The structure of the previously mentioned discs or plates will be discussed.

Referring to FIG. 2, the radiator section 18 is seen to include a substrate of dielectric material, at 54. Both exposed surfaces of the substrate are coated or laminated with conducting material at 50 and 52. This same type of basic lamination or structure pertains to both orthogonally mounted semi-circular radiators. Thus, the semi-circular radiator plate 14 includes the substrate 48 and conductive laminations or coatings 44 and 46. The outer conductor of r.f. input 34 makes direct electrical contact with the conductive layers 50 and 52, while the outer conductor of r.f. input 26 makes direct electrical contact with the conductive layers 44 and 46. However, the respective oppositely disposed parallel conductive layers 52 and 44 become energized for radiation by means of the center conductor of r.f. input cables 66 and 62 which extend through dielectric substrates 54 and 48 and make electric contact with the outer conducting layers 52 and 44 at points 68 and 64 respectively.

It is important to note that the two orthogonally positioned parallel plate radiators, that are filled with dielectric, can be collectively excited with a single input feed (see FIG. 4) or they can be independently excited in any phase relationship for changing polarization and direction of the radiation field. Present test models designed to operate in a typical frequency range (600 to 700 MHz) are 2½ inches high and approximately 5 inches in diameter. An epoxy FIBERGLASS (G-10) dielectric material was used as a substrate material for the individual disc type radiators. However, the present design technique has been used successfully with other dielectric materials at frequencies from 300 to 3,000 MHz. The separate coupling probes 26 and 34 are used at the input and positioned at desired impedance points (for example, 50-ohms) near the base of the antenna. A single coupling probe has also been used successfully at the cross-over point (45°) of the two radiators, positioned at desired impedance point (e.g. 50-ohms). This is explained hereinafter in connection with FIGS. 4 and 5.

Far field radiation patterns of the quadrature parallel-plate disc antenna have been obtained at 560 MHz with an 8 inch diameter antenna which was 4 inches high. A TEFLON-FIBERGLASS dielectric material was used between the individual parallel-plate radiators. The elevation pattern for a single excited radiator resulted in a gain of +2db and a beam width of approximately 100°. The azimuthal pattern for this same single radiator was dB as a double figure eight for the two orthogonal polarizations, resulting in nearly omnidirectional radiation in the azimuthal plane.

In-phase excitation of both orthogonal radiators has resulted in a typical gain for the quadrature-plate antenna of approximately 1db.

Radiation characteristics of the quadrature-plate antenna with both disc radiators excited in time and space quadrature result in the amplitude of the two polarization components in the forward direction being approximately the same, which in turn results in a circularly polarized antenna having good axial ratio of the radiation field.

Figure 4:
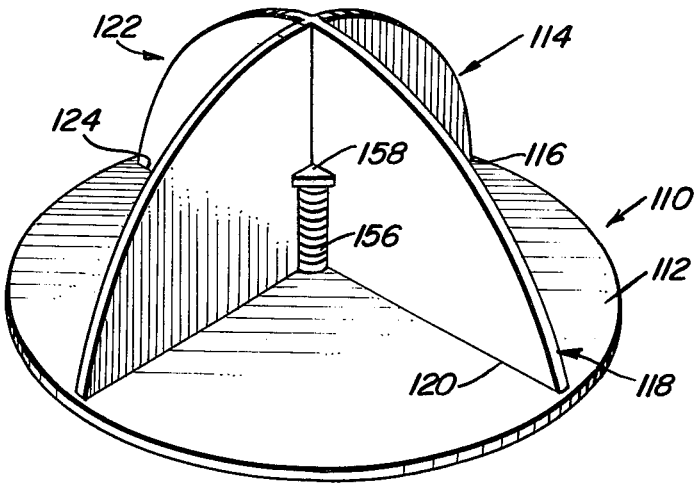
FIG. 4 is a perspective top view of a second embodiment of the present antenna.
Figure 5:
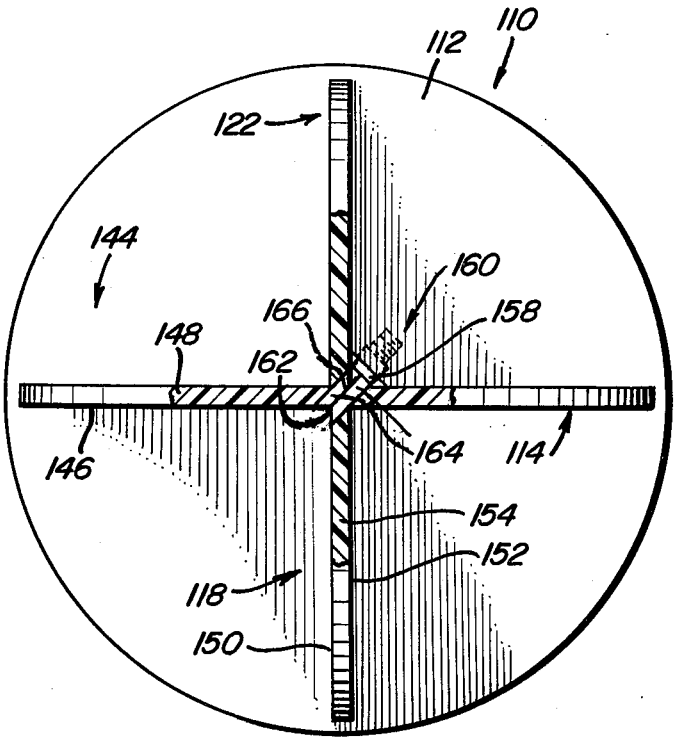
FIG. 5 is a top view of a second embodiment of the present antenna.

FIGS. 4 and 5 illustrate a modified embodiment of the present invention. The embodiment illustrated therein has the same basic radiator and ground plane construction as previously illustrated and explained in connection with FIGS. 1–3. Thus, the components of FIGS. 1–3, as indicated by reference numerals 10–54, have been correspondingly numbered 110–154. The components 156–166, in FIGS. 4 and 5 relate to a different type of r.f. input connector. This is different from the connectors associated with reference numerals 26–42 in FIGS. 1–3.

Referring to FIGS. 4 and 5, there is shown a modified type of low-profile UHF antenna of the quadrature parallel plate design. This design indicates a single r.f. input feed 156 that terminates in a metallic junction member 158. Actually, the feed 156 terminates under the ground plane member 112 in a conventional threaded fitting 160. The junction member 158 electrically connects the radiator plates that it is mounted to. A weld or wire 162 is electrically connected between the radiator plates, or conductive coatings 146 and 150. A lead 166 is connected between the center conductor of r.f. feed 156 and the connection means 162 thereby permitting the r.f. input to be applied simultaneously to the radiator members 146 and 150. The lead 166 passes through feed bore 164 which is subsequently filled with dielectric material to properly insulate it from the junction member 158.

The single r.f. input feed was developed to provide a radiation field having two orthogonal linearly polarized modes. The r.f. input is placed in a position that is 45° relative to the adjacent radiator plates, such that impedance matching is accomplished and both perpendicularly disposed radiators are equally excited. An actual design model has been successfully developed for use at 680 MHz, using an epoxy FIBERGLASS substrate material. The radiator plates had a measured thickness of approximately one-eighth inch and a semicircular plate diameter of about 5 inches. Of course these dimensions were only exemplary, actual dimensions a matter of design criteria. This relatively simple design, using a single r.f. feed makes it possible to transmit or receive both orthogonal linear components of the radiation field, whether it be linearly or circularly polarized. It is physically small, relatively simple to fabricate, efficient, and reproducible at low cost.

We wish it to be understood that we do not desire to be limited to the exact details of frequency range and construction shown and described, for obvious modifications can be made by a person skilled in the art.

Wherefore, the following is claimed:

1. A low-profile UHF antenna comprising:

a ground plane member;

a pair of radiator members, each member comprising a plate-shaped radiator containing a substrate with conductive laminations serving as radiating elements, orthogonally positioned in intersecting relationship with respect to each other, the radiator members being mechanically and electrically connected to the ground plane member; and means connected to at least one of the radiator members at the outer conductive layer surface thereon for coupling an input r.f. signal to the radiator member.

2. The subject matter set forth in claim 1 wherein the coupling means comprises a first and second input coupling probe for coupling respective input r.f. signals to the pair of radiator members.

3. The subject matter of claim 1 wherein each radiator member comprises parallel spaced conductive layers mounted on opposite sides of an intermediate layer.

4. The subject matter of claim 3 wherein each intermediate layer is fabricated from a dielectric material.

5. The subject matter of claim 1 wherein each plate-shaped radiator member is semi-circular, a dimetrical edge of each member perpendicularly abutting the ground plane member.

6. The subject matter of claim 2 together with means connected to the first and second input coupling probes for simultaneously feeding the radiator members with the same r.f. signal.

7. The subject matter of claim 2 wherein each radiator member comprises parallel spaced conductive layers mounted on opposite sides of an intermediate layer.

8. The subject matter of claim 7 wherein each intermediate layer is fabricated from a dielectric material.

9. The subject matter of claim 8 wherein each plate-shaped radiator member is semi-circular, a dimetrical edge of each member perpendicularly abutting the ground plane member.

10. The subject matter of claim 9 together with means connected to the first and second input coupling probes for simultaneously feeding the radiator members with the same r.f. signal.

11. The subject matter of claim 2 together with switching means provided in line with both the first and second coupling probes for switching the input r.f. signals to opposite radiating members thereby changing polarization (linear) direction.

12. The subject matter set forth in claim 1 wherein a single means is provided for coupling an input r.f. signal to the pair of radiator members.

13. The subject matter of claim 12 wherein each radiator member comprises parallel spaced conductive layers mounted on opposite sides of an intermediate layer.

14. The subject matter of claim 13 wherein each intermediate layer is fabricated from a dielectric material.

15. The subject matter of claim 14 wherein each plate-shaped radiator member is semi-circular, a dimetrical edge of each member perpendicularly abutting the ground plane member.

16. The subject matter of claim 2 together with means connected to the first and second input coupling probes for driving the radiators in phase quadrature giving the antenna a circularly polarized mode.

* * * * *